US012225959B2

(12) United States Patent
Herperger

(10) Patent No.: US 12,225,959 B2
(45) Date of Patent: Feb. 18, 2025

(54) INFLATABLE HELMET

(71) Applicant: VENTETE LIMITED, London (GB)

(72) Inventor: Colin Herperger, London (GB)

(73) Assignee: Ventete Limited, London (GB)

( * ) Notice: Subject to any disclaimer, the term of this patent is extended or adjusted under 35 U.S.C. 154(b) by 129 days.

(21) Appl. No.: 17/557,508

(22) Filed: Dec. 21, 2021

(65) Prior Publication Data

US 2022/0192308 A1 Jun. 23, 2022

(30) Foreign Application Priority Data

Dec. 23, 2020 (GB) ..... 2020491.3

(51) Int. Cl.
*A42B 3/12* (2006.01)
*A42B 3/32* (2006.01)

(52) U.S. Cl.
CPC ..... *A42B 3/122* (2013.01); *A42B 3/322* (2013.01)

(58) Field of Classification Search
CPC ..... A42B 3/122; A42B 3/322; A42B 3/00; A42B 3/0493; A42B 3/121; A42B 3/32; A42B 3/0486; A42B 1/203; Y10S 2/03; Y10S 2/10; Y10S 2/909
USPC ..... 2/413, 909, DIG. 3, DIG. 10
See application file for complete search history.

(56) References Cited

U.S. PATENT DOCUMENTS 1,072,321 A 9/1913 Fitch
1,560,073 A 11/1925 Bontempi et al.
2,759,186 A 8/1956 Dye
2,803,015 A * 8/1957 Milone ..... A42B 1/203 2/171.03
3,039,109 A 6/1962 Simpson
3,169,251 A 2/1965 Humes, Jr.
3,555,561 A * 1/1971 Neis ..... A42B 3/322 D29/105
3,761,959 A 10/1973 Dunning
3,787,893 A 1/1974 Larcher
4,035,846 A 7/1977 Jencks
4,324,005 A 4/1982 Willis
4,354,284 A 10/1982 Gooding
(Continued)

FOREIGN PATENT DOCUMENTS

AU 512331 B2 10/1980
CN 0394726 A1 * 10/1990
(Continued)

OTHER PUBLICATIONS

English machine translation of DE 2823370 A1. Via espacenet.com. Translation performed on Aug. 25, 2023. (Year: 1979).*
(Continued)

*Primary Examiner* — Jameson D Collier
(74) *Attorney, Agent, or Firm* — Barnes & Thornburg LLP

(57) ABSTRACT

An inflatable helmet including a plurality of elongate inflatable members, each elongate inflatable member having at least one chamber wall defining an inflatable chamber; wherein at least two adjacent elongate inflatable members are in fluid communication with each other; and wherein the plurality of elongate inflatable members are inflatable so as to adjust the inflatable helmet from a collapsed state to an inflated state in which at least one pair of adjacent elongate members abut one another along at least a portion of their respective chamber walls.

14 Claims, 12 Drawing Sheets

(56) References Cited

U.S. PATENT DOCUMENTS

| | | | | | |
|---|---|---|---|---|---|
| 4,547,919 | A | * | 10/1985 | Wang | B63B 7/08 428/116 |
| 4,825,469 | A | | 5/1989 | Kincheloe | |
| D318,747 | S | * | 7/1991 | Barker | D29/106 |
| 5,095,545 | A | | 3/1992 | Lane | |
| 5,129,107 | A | * | 7/1992 | Lorenzo | A42B 1/203 2/413 |
| 5,259,070 | A | * | 11/1993 | De Roza | A42B 3/122 2/93 |
| 5,263,203 | A | | 11/1993 | Kraemer et al. | |
| 6,065,150 | A | | 5/2000 | Huang | |
| 6,065,158 | A | | 5/2000 | Rush, III | |
| 6,423,019 | B1 | | 7/2002 | Papay et al. | |
| 8,481,804 | B2 | | 7/2013 | Timothy | |
| 9,032,549 | B1 | | 5/2015 | Cameron | |
| 2006/0202492 | A1 | | 9/2006 | Barvosa-Carter et al. | |
| 2008/0282453 | A1 | | 11/2008 | Alstin et al. | |
| 2013/0276213 | A1 | | 10/2013 | Olsson et al. | |
| 2014/0007324 | A1 | | 1/2014 | Svehaug | |
| 2015/0313305 | A1 | | 11/2015 | Daetwyler et al. | |
| 2017/0251747 | A1 | | 9/2017 | Pippin | |
| 2018/0027915 | A1 | | 2/2018 | Cadens Ballarin et al. | |
| 2019/0125025 | A1 | * | 5/2019 | Williams | A42B 3/066 |
| 2020/0154813 | A1 | * | 5/2020 | Wendelrup | A42B 3/00 |

FOREIGN PATENT DOCUMENTS

| | | | | | |
|---|---|---|---|---|---|
| DE | 2823370 | A1 | * | 12/1979 | |
| DE | 3537095 | A1 | | 7/1986 | |
| EP | 0394726 | A1 | | 10/1990 | |
| EP | 3232844 | B1 | * | 2/2019 | A42B 1/201 |
| ES | 1077831 | U | | 10/2012 | |
| FR | 1071094 | A | * | 8/1954 | |
| WO | WO2016/030547 | A1 | | 3/2016 | |

OTHER PUBLICATIONS

European Search Report prepared for European Patent Application No. 21216460.2, mailed May 24, 2022.

PCT Search Report prepared for PCT Application No. PCT/EP2015/069881, mailed Jul. 12, 2015.

* cited by examiner

INFLATABLE HELMET

CROSS-REFERENCE TO RELATED APPLICATIONS

This application claims the benefit of U.K. application no. GB2020491.3, filed Dec. 23, 2020, the entire disclosure of which is incorporated herein by reference in its entirety.

FIELD

The present disclosure relates to inflatable helmets. The inflatable helmet may be useful as a protective helmet, for cycling, motorcycling, or for use as protective wear during sports and any other activities in which protective wear may be required or be beneficial. Such other activities may include skateboarding, rollerblading, skating, and kitesurfing.

BACKGROUND

Conventional cycling helmets are formed of solid, rigid material, and therefore have a particular permanent size and volume. This can be inconvenient, particularly because there may be little room to store a conventional cycling helmet. It is desirable to have a cycling helmet that is inflatable, and can therefore collapse and be compressed to a compact form when not in use, and re-inflated for use. However, inflatable structures often lack strength and rigidity.

A known inflatable helmet is described in European Patent No. EP3232844. This uses a lattice-like structure to form a rigid structure.

The inventors have appreciated that the diagonal struts of the helmet described in EP3232844 are subject to distortion in the event of a hard impact. Further, it is difficult to join the struts to the longitudinal members in a manner which is both strong and does not allow air to leak.

The inventors have appreciated a need for an inflatable or collapsible helmet that is capable of withstanding structural forces of the conventional impact tests required for cycling helmets (for example, EN1078). The inventors have further appreciated a need for a helmet designed to be manufactured effectively and efficiently. The inventors have further appreciated a need for a helmet that may be stored easily and effectively when not in use.

SUMMARY

The present disclosure includes one or more of the features recited in the appended claims and/or the following features which, alone or in any combination, may comprise patentable subject matter.

The present disclosure provides an inflatable helmet. The inflatable helmet comprises a plurality of elongate members. Each elongate member comprises at least one chamber wall defining an inflatable chamber. At least two (or a pair of) adjacent elongate members are in fluid communication with each other. The plurality of elongate members is inflatable so as to adjust the inflatable helmet from a collapsed state to an inflated state. In an inflated state, at least one pair of adjacent elongate members abut each other along at least a portion of their respective chamber walls.

The helmet of the present disclosure may be capable of being collapsed or deflated and conveniently stored away in a collapsed state until a user needs to use to it by inflating the helmet to an inflated state. By providing elongate members that are abutting each other along at least a portion of their respective chamber walls, when the helmet is inflated, embodiments of the helmet of the present disclosure may also provide improved structural rigidity and impact performance during use in an inflated state.

In an inflated state, adjacent elongate members of the plurality of elongate members may abut each other along at least a longitudinal portion of their respective chamber walls. In other words, adjacent elongate members are either touching or are coupled to each other along at least a longitudinal portion of their respective chamber walls.

Adjacent elongate members may directly abut each other along at least a longitudinal portion of their respective chamber walls. The term 'directly abut' refers to the fact that two elements or components are touching or are coupled to each other, with no other intermediate elements or components, or even gaps, between them in locations where they are abutting. In an inflated state, the (at least one pair) adjacent elongate members may abut each other along a majority of the length of their respective chamber walls.

The inflatable helmet may be collapsible from an inflated state to a collapsed (or deflated) state. The plurality of elongate members may be deflatable so as to adjust the inflatable helmet from an inflated state to a collapsed state. This advantageously ensures that the inflatable helmet can be stored away after being inflated to an inflated state from a collapsed state.

In a collapsed state, each of the elongate members may be substantially flattened such that the shape of the helmet in a collapsed state is substantially flatter than the shape of the helmet in an inflated state. The shape of the helmet in a collapsed state may be substantially flatter in a transverse direction than the shape of the helmet in an inflated state.

In the collapsed state, adjacent elongate members may be joined or coupled to each other at at least one location or portion of their respective chamber walls. In the collapsed state, adjacent elongate members may be joined or coupled to each other at at least one longitudinal location or portion of their respective chamber walls. The remaining longitudinal portions, or length, of the respective chamber walls of joined, adjacent elongate members may not be coupled or joined to each other. The remaining longitudinal portions of the respective chamber walls of joined, adjacent elongate members may or may not abut each other in the collapsed state. In an inflated state, such remaining portions of the respective chamber walls of adjacent elongate members may abut each other in an inflated state. However, some of such remaining portions of the respective chamber walls of adjacent elongate members may not abut each other in a collapsed state.

In other words, in a collapsed state, adjacent elongate members are coupled to each other along a first portion of their respective chamber walls. Such a first portion (or first portions) of a chamber wall comprises, or, in other embodiments, consists of, a portion of the chamber wall that is coupled to another chamber wall. In an inflated state, adjacent elongate members may abut each other along a second portion of their respective chamber walls. In an inflated or a collapsed state, adjacent elongate members may abut each other along a second portion of their respective chamber walls. Such a second portion of a chamber wall comprises, or, in other embodiments, consists of, a portion of the chamber wall that is not coupled or joined to another chamber wall. Such a second portion of a chamber wall may comprise the majority of the length of the chamber wall. In other words, such a second portion of a chamber wall, which is configured to abut a second portion of the chamber wall of an adjacent elongate member, may comprise at least 50 percent of the length of the chamber wall. Such a second portion of a chamber wall may comprise at least 60 percent of the length of the chamber wall. Such a second portion of a chamber wall may comprise at least 75 percent of the length of the chamber wall.

Accordingly, while adjacent elongate members may abut each other in a collapsed or deflated state, they are configured to abut each other along longer portions of their respective chamber walls in an inflated state. This is because the elongate, inflatable members are wider in an inflated state than in a collapsed state. As a result, the fluidly connected elongate members abut each other more (that is, along a greater length of their respective chamber walls) in an inflated state than in a collapsed state. Such an increase in abutment ensures there is more contact amongst adjacent elongate members in an inflated state, which ensures the helmet can sustain impact and minimize transfer of such an impact to a user's head, while also ensuring that the helmet can be stored away in a more compact form.

The elongate members may extend substantially along a longitudinal direction of the helmet. The elongate members of the helmet wholly or partially extend between a rear end of the helmet and a front end of the helmet. The elongate members are configured to expand laterally (that is, along a transverse direction of the helmet extending between both the left and right sides) or transversely. Accordingly, a width of each of the elongate members may be greater in an inflated state than a width of each of the elongate members in a collapsed or deflated state.

The elongate members may be substantially parallel to each other, at least in a collapsed state of the inflatable helmet. Providing the elongate members substantially parallel to each other at least in a collapsed state of the helmet, ensures that the width of the helmet is minimized so that the helmet can occupy less space and be stored easily by a user.

Each elongate member may comprise at least one aperture defined in the chamber wall. The at least one aperture of an elongate member may be fluidly connected to at least one corresponding aperture of an adjacent elongate member. This ensures there is direct abutment between adjacent elongate members in an inflated state, while establishing a fluid communication between such elongate members so that they can be inflated. The at least one aperture of an elongate member may be coupled to at least one corresponding aperture of an adjacent elongate member. The apertures may be coupled by welding, as described in further detail in the present disclosure.

The plurality of elongate members may comprise two external (or outer) elongate members and at least one internal (or inner) elongate member located between the external elongate members. The at least one internal elongate member may comprise at least one first aperture located on a first side of the inflatable chamber and at least one second aperture located on an opposing second side of the inflatable chamber. The at least one first aperture of an internal elongate member may be fluidly connected to at least one corresponding aperture of an adjacent elongate member. The at least one second aperture of an internal elongate member may be fluidly connected to at least one corresponding aperture of another adjacent elongate member. The inflatable helmet may comprise at least five internal elongate members. In some embodiments, the inflatable helmet comprises at least eight internal elongate members. The inflatable helmet may comprise two external elongate members and at least nine internal elongate members. Some of the internal elongate members are shorter in length than other internal elongate members and the external elongate members.

Each elongate member may comprise a plurality of apertures defined in the chamber wall. The apertures of the plurality of apertures may be longitudinally spaced amongst each other. Providing a plurality of longitudinally-spaced apertures ensures that adjacent elongate members can be fluidly connected, while providing an effective and quick inflation of the helmet.

The portion of the chamber wall surrounding the at least one aperture of an elongate member may be coupled to the portion of the chamber wall surrounding the at least one corresponding aperture of an adjacent elongate member such that an airtight seal is provided around the apertures.

The chamber wall of each elongate member may comprise an inner layer and an outer layer. This enhances the structural integrity of the chamber walls.

A portion of the chamber wall surrounding the at least one aperture may comprise one of the inner layer and the outer layer. In some embodiments, a portion of the chamber wall surrounding the at least one aperture may consist of the inner layer or the outer layer. Such a portion of the chamber wall may correspond to a portion of the chamber wall located at the periphery of an aperture. As discussed further below in the present disclosure, a portion of the outer layer surrounding the at least one aperture may be removed to expose the inner layer.

The chamber wall of each elongate member may comprise at least one longitudinal seam. The at least one longitudinal seam may be formed by joining a longitudinal portion of one of the inner layer and outer layer to another longitudinal portion of either the same one of the inner layer and outer layer or a different one of the inner layer and outer layer. The at least one longitudinal seam may be formed by joining a longitudinal portion of an outer layer to another longitudinal portion of either the same outer layer or a different outer layer. The chamber wall of each elongate member may comprise a first wall and a second wall. The first and second walls may be joined together by an upper longitudinal seam and a lower longitudinal seam. Alternatively, the chamber wall of each elongate member may be defined by a single wall element, the edges of which are joined together to form at least one longitudinal seam, in order to form an inflatable chamber.

Each longitudinal seam may be reinforced by a rib member. The reinforcing rib member may be coupled to each longitudinal seam. The rib member may enclose or encapsulate each longitudinal seam. Each elongate member may comprise at least one rib member. Each elongate member may comprise a lower rib member and an upper rib member, respectively corresponding to a lower longitudinal seam and an upper longitudinal seam.

The inner layer may comprise an outer lamina of plastic material and an inner lamina of woven material. The outer layer may comprise an outer lamina of woven material and an inner lamina of plastic material. At least a portion of the inner lamina of the outer layer overlapping the outer lamina of the inner layer may be joined to the outer lamina of the inner layer such that an airtight seal is formed between the outer and inner layers of the chamber wall.

In the present disclosure, there is also provided an inflatable article. The inflatable article may comprise a plurality of inflatable members. Each inflatable member may comprise at least one chamber wall defining an inflatable chamber. At least two adjacent inflatable members may be in fluid communication with each other. The plurality of inflatable members may be inflatable so as to adjust the inflatable article from a collapsed state to an inflated state. In an inflated state, at least one pair of adjacent inflatable members abut each other along at least a portion of their respective chamber walls. The inflatable members may be elongate members. In an inflated state, at least one pair of adjacent elongate members abut each other along at least a portion of their respective chamber walls. The inflatable article may be a wearable article.

Each inflatable member may comprise at least one aperture defined in the chamber wall. The at least one aperture of an inflatable member may be fluidly connected to at least one corresponding aperture of an adjacent inflatable member. The portion of the chamber wall surrounding the at least one aperture of an inflatable member may be coupled to the portion of the chamber wall surrounding the at least one corresponding aperture of an adjacent inflatable member such that an airtight seal is provided around the apertures. The chamber wall of each inflatable member may comprise an inner layer and an outer layer.

A portion of the chamber wall surrounding the at least one aperture may consist of one of the inner layer and the outer layer. The inflatable article may be inflatable from a collapsed state to an inflated state.

The inflatable article may be collapsible from an inflated state to a collapsed state. In a collapsed state, each of the inflatable members may be substantially flattened such that the shape of the article in a collapsed state is substantially flatter than the shape of the article in an inflated state.

The inflatable members extend along a longitudinal direction of the article. Preferably, some or all of the inflatable members are arranged substantially parallel to each other. Some or all of the inflatable members may be arranged substantially parallel to each other, in a collapsed state. The inflatable members of the inflatable article may be elongate members, with similar characteristics to those of the inflatable helmet described in the present disclosure.

The chamber wall of each inflatable member may comprise at least one longitudinal seam. The at least one longitudinal seam may be formed by joining a longitudinal portion of one of the inner layer and outer layer to another longitudinal portion of either the same one of the inner layer and outer layer or a different one of the inner layer and outer layer. Preferably, the at least one longitudinal seam is formed by joining a longitudinal portion of an outer layer to another longitudinal portion of either the same outer layer or a different outer layer.

Similar to the inflatable helmet of the present disclosure, the inner layer may comprise an outer lamina of plastic material and an inner lamina of woven material. The outer layer may comprises an outer lamina of woven material and an inner lamina of plastic material. At least a portion of the inner lamina of the outer layer overlapping the outer lamina of the inner layer may be joined to the outer lamina of the inner layer such that an airtight seal is formed between the outer and inner layers of the chamber wall.

Any feature in one aspect of the disclosure may be applied to other aspects of the disclosure, in any appropriate combination. Furthermore, any, some and/or all features in one aspect may be applied to any, some and/or all features in any other aspect, in any appropriate combination. In particular, any method features provided in relation to the first aspect may be applied to any of the other aspects.

It should also be appreciated that particular combinations of the various features described and defined in any aspects of the disclosure may be implemented and/or supplied and/or used independently.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
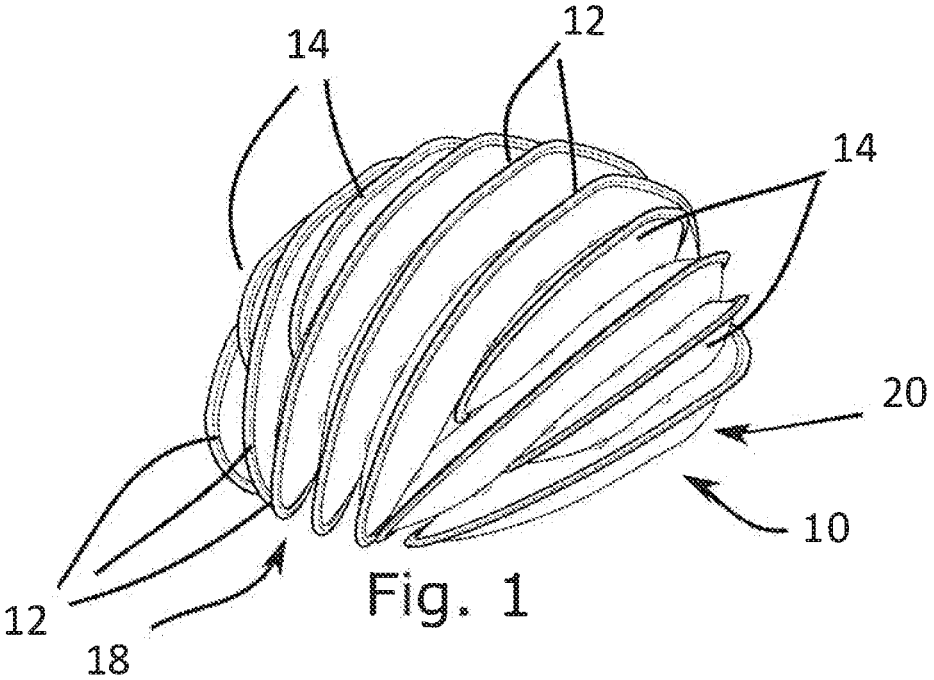
FIG. 1 is a perspective view of a helmet in an inflated state according to an embodiment of the present disclosure.
Figure 2:
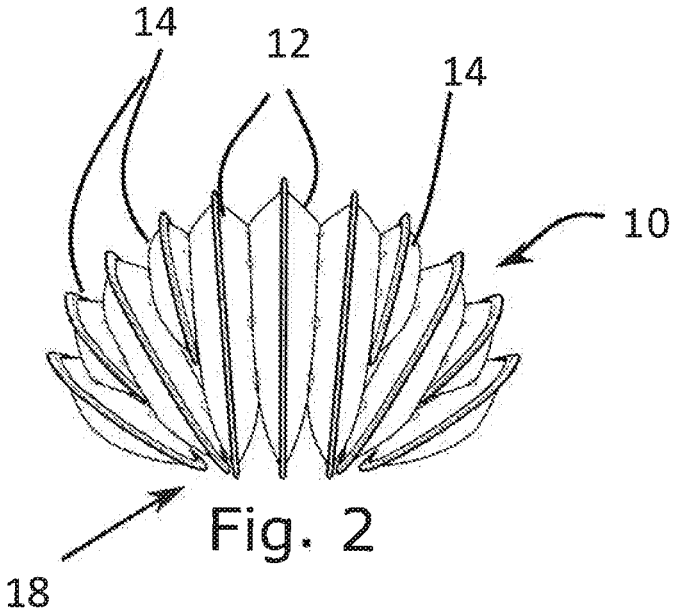
FIG. 2 is a front view of the helmet of FIG. 1 in an inflated state.
Figure 3:
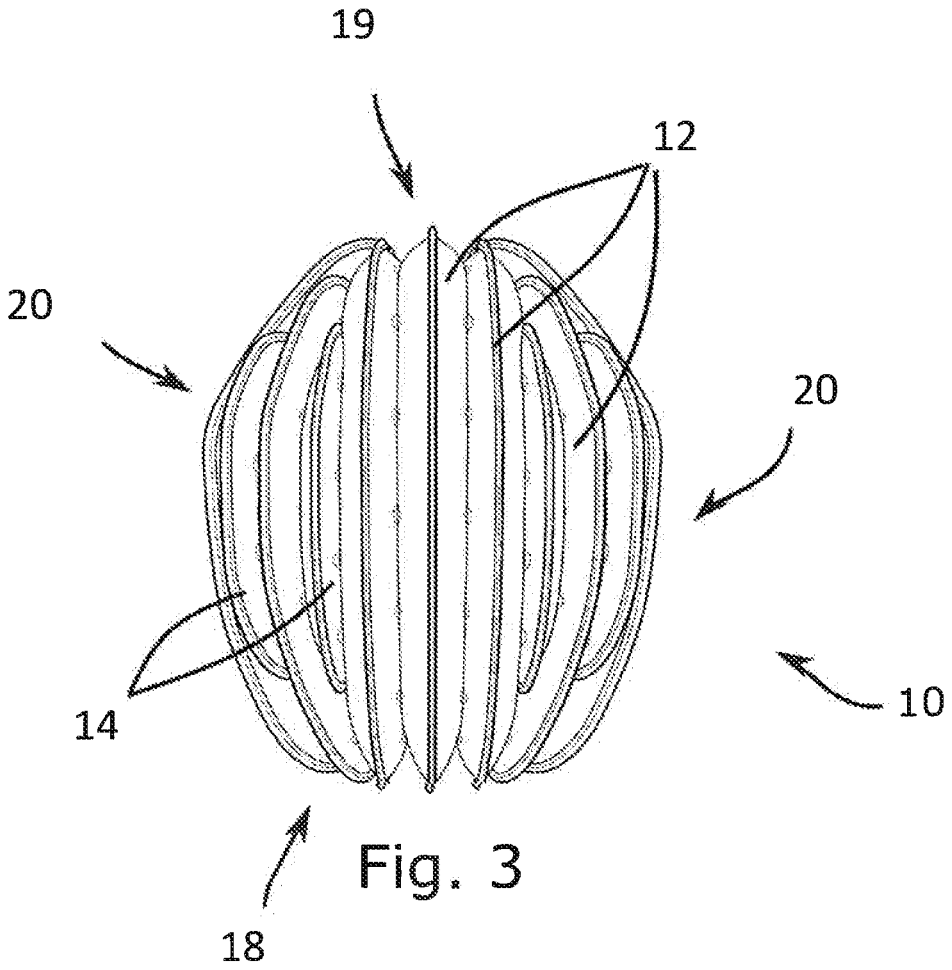
FIG. 3 is a plan view of the helmet of FIG. 1 in an inflated state.

Referring to FIGS. 1 to 3, a helmet 10 according to an embodiment of the present disclosure comprises a series of longitudinal members 12, 14, arranged side-by-side to each other. The helmet 10 has a generally curved with a concave inside shape and a convex outside shape, though somewhat flattened, with a front end 18 and rear end 19 and two side edges 20, and each longitudinal member 12, 14 being curved and aligned approximately longitudinally and generally parallel to its neighboring members, but at an increasing inclination, so that the longitudinal members 12, 14 together form the curved profile of the helmet 10. Some longitudinal members 12 extend fully between the front edge 18 and rear edge 19, converging at those two regions. Other longitudinal members 14 are shorter, and occupy positions between the fully extending longitudinal members 12 that would otherwise be left between the fully extending longitudinal members 12 at the middle region of the helmet. All the longitudinal members 12 may be tapered towards their terminal ends so that they fit together in the hemispherical arrangement.

Each longitudinal member 12, 14 is inflatable, having an airtight skin (or chamber wall) that defines an inflatable chamber, and the chambers of longitudinal members 12, 14 are in fluid communication with each other. In FIGS. 1 to 3, the longitudinal members 12, 14 are shown fully inflated, so that they assume a helmet-like shape or profile.

Figure 4:
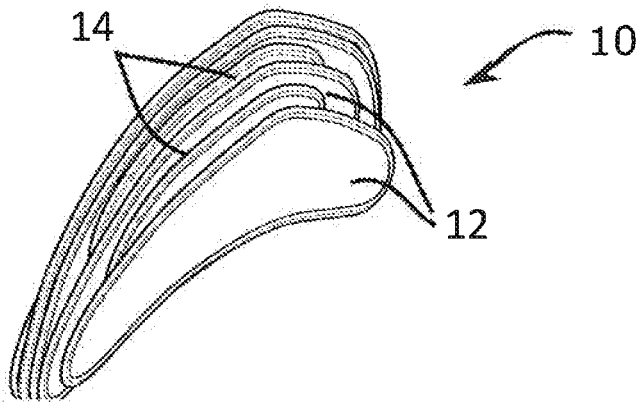
FIG. 4 is a perspective view of helmet of FIG. 1 in an uninflated, deflated or collapsed state.
Figure 5:
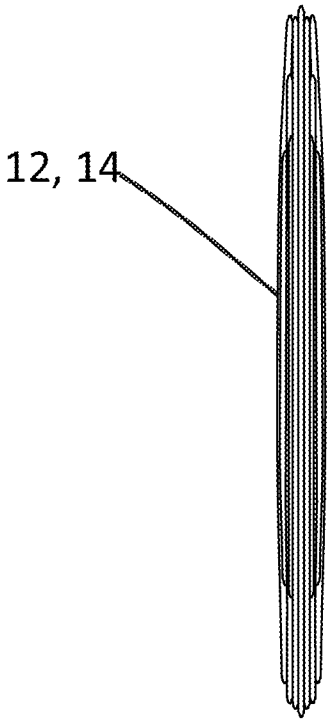
FIG. 5 is a front view of the helmet of FIG. 1 in an uninflated state.
Figure 6:
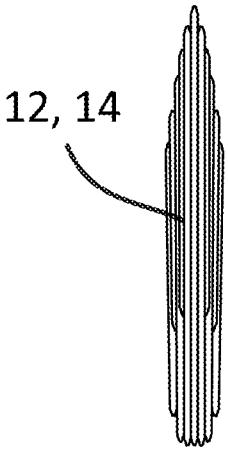
FIG. 6 is a plan view of the helmet of FIG. 1 in an uninflated state.

Referring to FIGS. 4 to 6, when the chambers of longitudinal members 12, 14 are evacuated, the longitudinal members 12 may be compressed or collapsed in a lateral direction so the longitudinal members 12, 14 and the helmet 10 as a whole attain a relatively flat state, the planar form of each longitudinal members 12, 14 being now parallel with every other flattened longitudinal member 12, 14. In this deflated, relatively flat state, the helmet 10 takes up little room and may more conveniently be stored.

Figure 7:
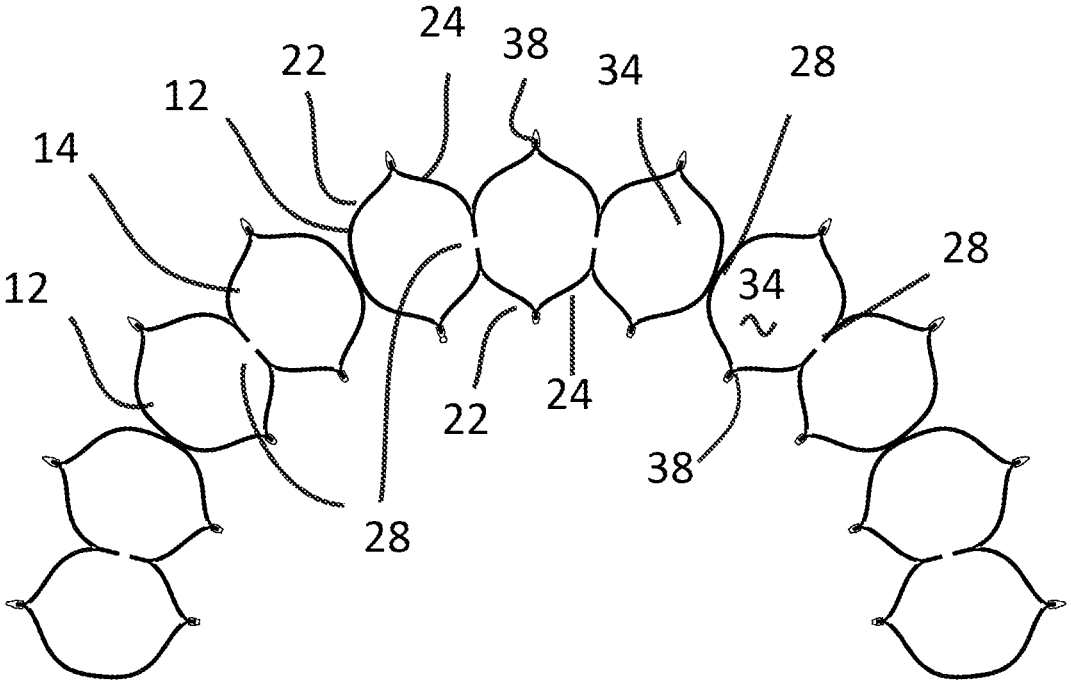
FIGS. 7 and 8 are cross sections of an embodiment of the helmet in an inflated state.
Figure 8:
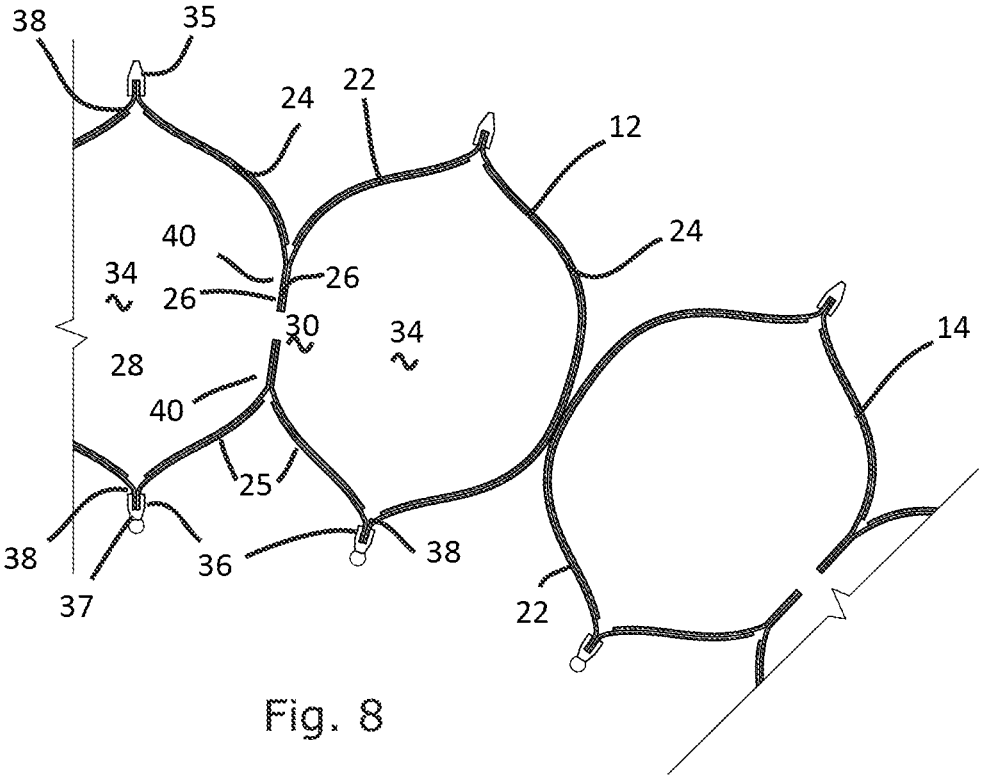

Referring to FIGS. 7 and 8, each longitudinal member 12, 14 comprises a chamber cavity 34 defined by a first wall 22 and a second wall 24. The first wall 22 and second wall 24 are joined along their respective upper edges and respective lower edges with a surface to surface connection 38, where material from the first wall 22 and second wall 24 are superimposed to form a seam. Each longitudinal member 12, 14 thus has two surface to surface connections 38, one running longitudinally along the outside of the helmet 10, and one running longitudinally along the inside of the helmet 10. Each surface to surface connection 38 is encapsulated along the length (or along the majority of the length) with a linear perimeter rib 35, 36, which provides further structural strength and rigidity to the longitudinal members, strengthens the surface to surface connection 38, spreads the load during impact across more of the chamber, and reduces friction under impact. A reduction in friction means an impact force will slide over the surface of the helmet rather than be absorbed by it. The inside linear perimeter rib 36 features a padded member 37 which extends along the inside linear perimeter rib 36 to provide a soft surface that sits on the user's head. The rib may be formed from nylon.

As previously described, each longitudinal member 12, 14 is joined to the members directly adjacent to it in fluid communication, so that the helmet 10 may be inflated or deflated by respectively introducing or letting out air in any one of the longitudinal members.

The longitudinal members 12, 14 are joined by nodes 28 formed by apertures 30 in the walls 22, 24. The aperture 30 of a first wall 22 of one longitudinal member 12, 14 is joined to the aperture 30 of a second wall 24 of the adjacent longitudinal member 12, 14. This arrangement is repeated for each neighboring pair of longitudinal members 12, 14. The material of the first and second walls of adjacent longitudinal members are superimposed with coincident edges, and joined in this region to form a surface to node connection 40. The surface to node connection 40 thus has a double layer of material, and is generally annular, the aperture 30 being generally circular.

Figure 9:
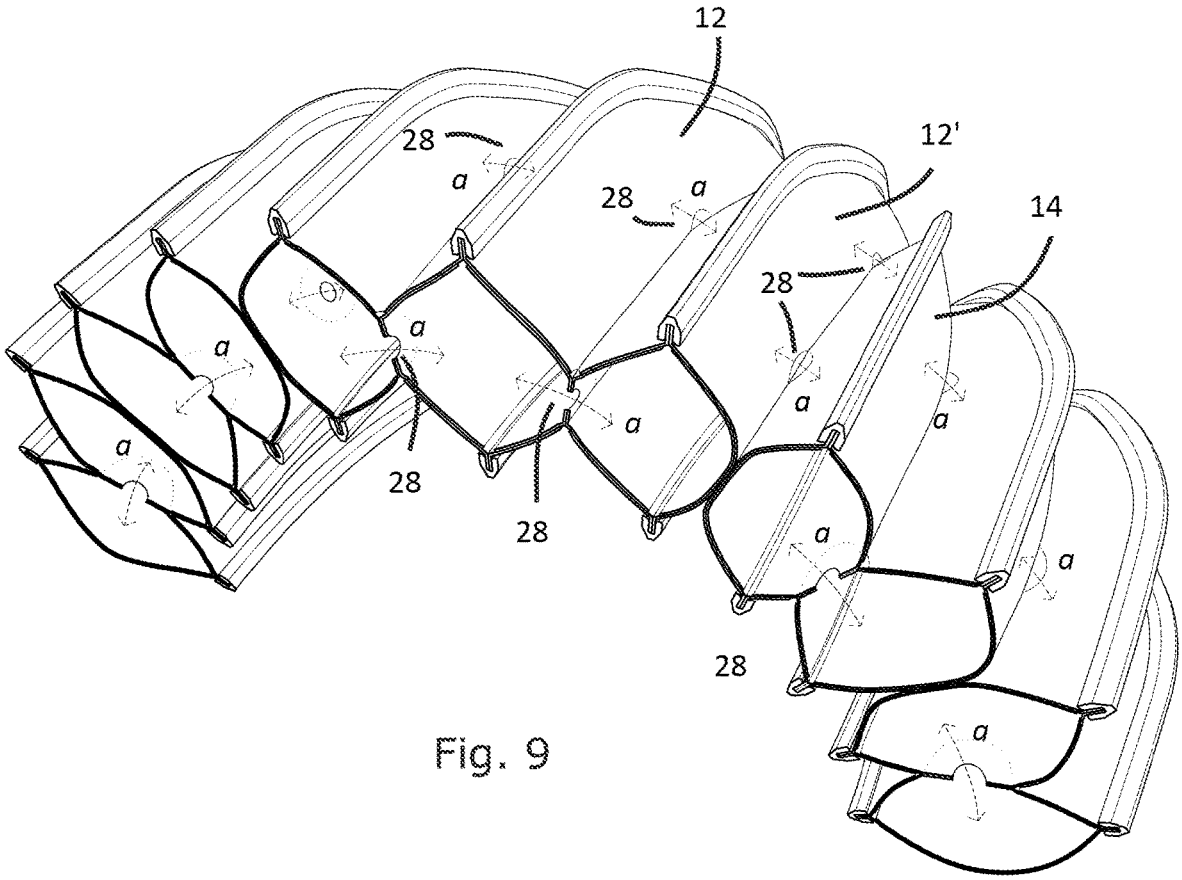
FIG. 9 is a perspective section of the helmet shown in FIGS. 7, 8 showing the airflow on impact.

Referring also to FIG. 9, nodes 28 are located along the longitudinal members 12, 14 in a periodic manner. Considering longitudinal member 12' as an example, the nodes 28 formed with longitudinal member 12 are longitudinally spaced compared to the nodes 28 formed with longitudinal member 14. This means that air flow through nodes joining the longitudinal members cannot simply flow from one side of the helmet to the other in a straight line, but must take a convoluted path by having to travel longitudinally along the longitudinal member to the next node, with the path of air flow through the nodes being indicated by arrows a. This arrangement increases the resistance of the airflow, causing the helmet 10 to be stiffer in the event of an impact at a point on the helmet.

It may though be convenient to have some longitudinal members, such as the center-most longitudinal member 12 shown in FIG. 9, to have nodes 28 on each side of the longitudinal member 12. Such nodes 28 are laterally aligned on both sides.

Figure 10:
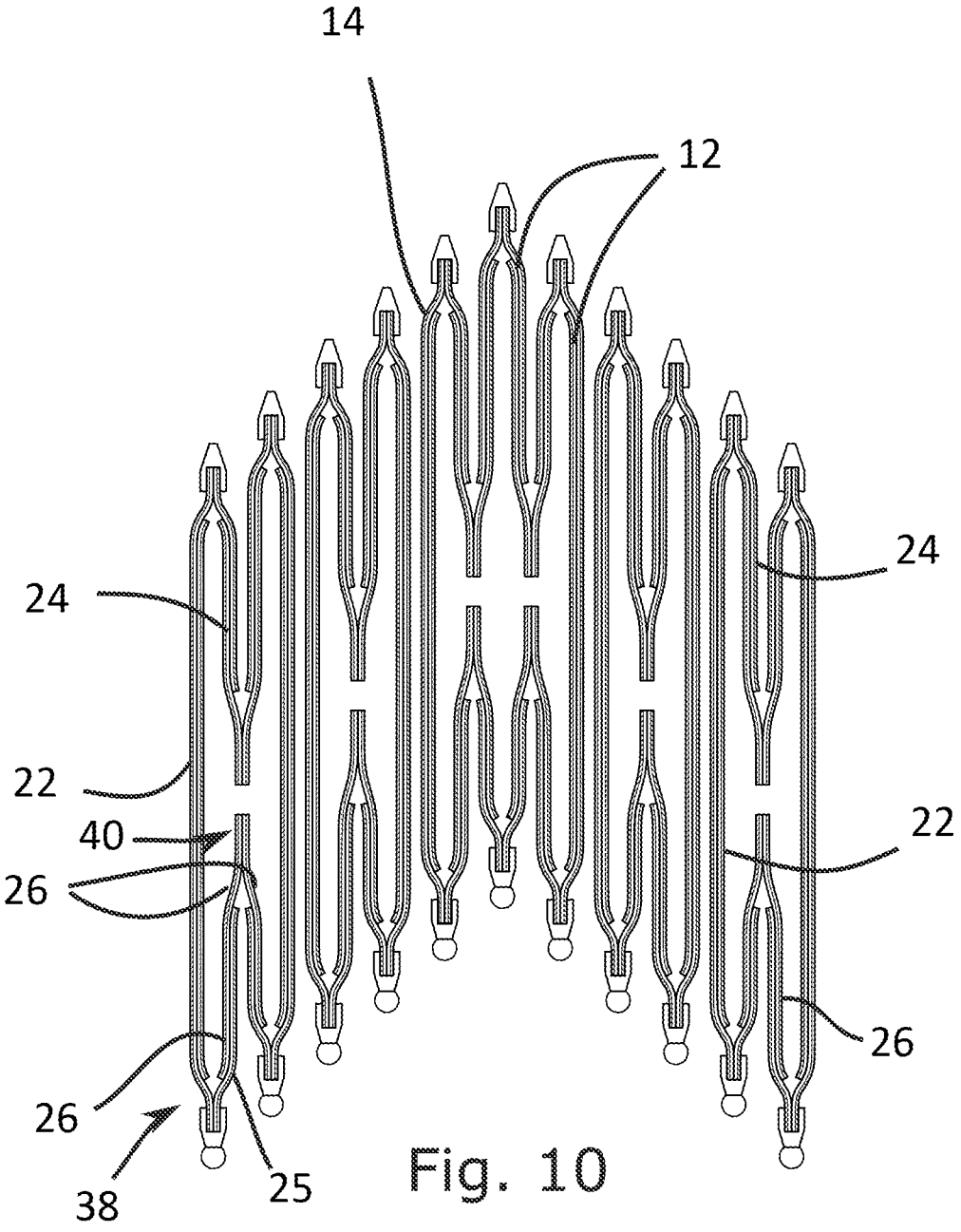
FIG. 10 is a cross section of the helmet of FIGS. 7, 8 in an uninflated state.
Figure 11:
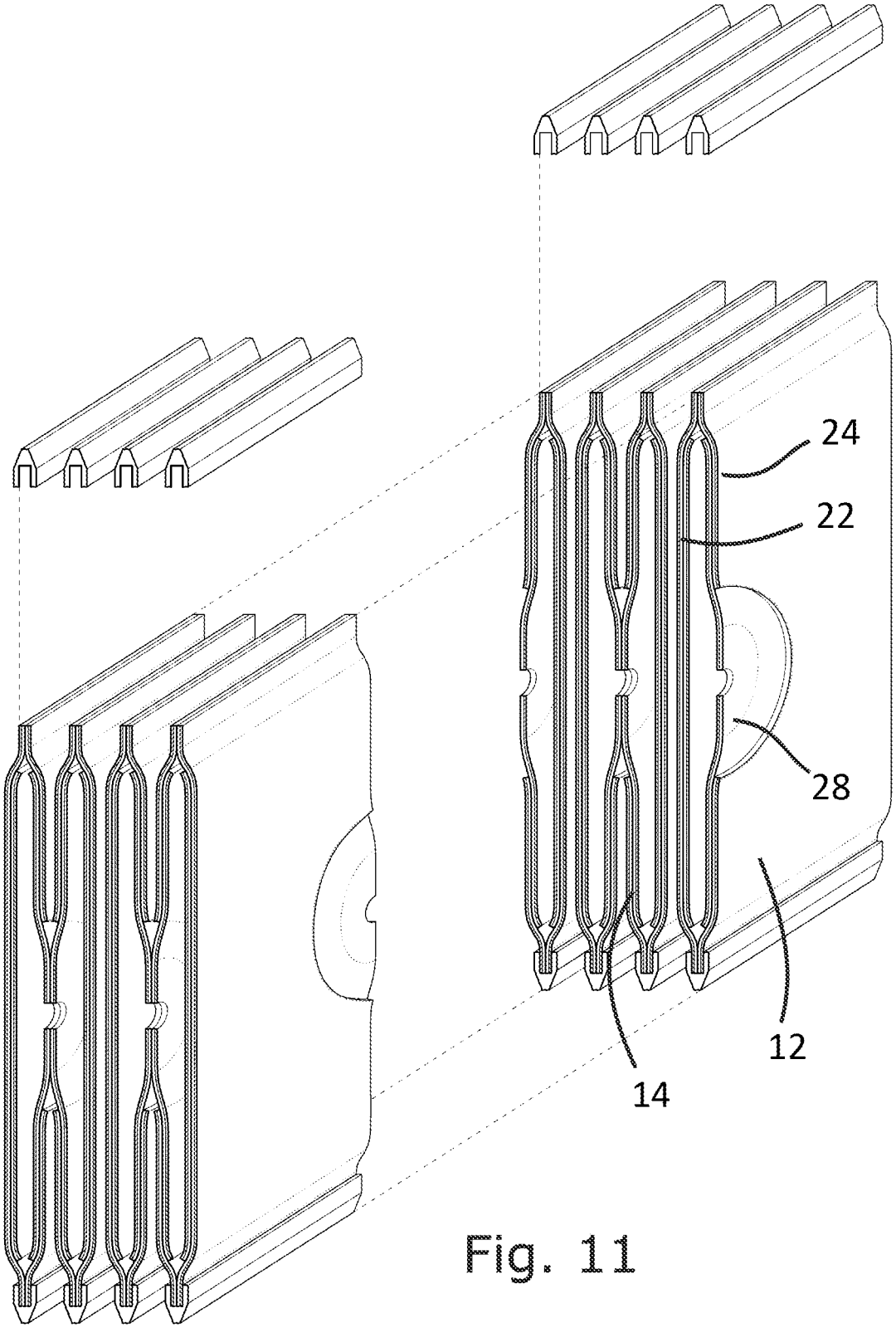
FIG. 11 is a perspective section of the helmet of FIGS. 7, 8 in an uninflated state.

Referring to FIGS. 10 and 11, when air is pumped from the helmet 10 to deflate it, the longitudinal members 12, 14, contract in a lateral direction in a concertina-like manner, and the walls 22, 24 take a planar shape, so that all the walls 22, 24 are arranged in a generally parallel manner across the helmet, though arranged at different heights due to the hemispherical form or curved profile of the helmet 10.

The first and second walls 22, 24 are ideally formed from a double-layered material, each wall of the longitudinal member 12, 14 being formed from an interior (or inner) layer (or lamina) 26 and an exterior (or outer) layer (or lamina) 25. Each single layer itself ideally a laminate material, one possible embodiment of which is described in further detail in FIGS. 12 to 14.

To bond or join adjacent longitudinal members 12, 14, together at the surface to node connection 40 the exterior layer or lamina of a wall of each longitudinal member 12, 14 is removed in that region, so that the two adjoining interior layers 26 can be secured together.

To bond the first wall 22 and second wall 24 of a longitudinal member 12, 14, at the surface to surface connection 38, the interior layer 26 of the first wall 22 and the second wall 24 are both removed, and the remaining exterior layer 25 of the first wall 22 and the second wall 24 are superimposed and welded to create a seam.

Rather than removing a layer of the wall, the wall could be formed without the layer being present in that region.

The nodes 28 are placed approximately at equidistant points from each other along the length of each longitudinal member, thus spreading the forces across the structure.

Figure 12:
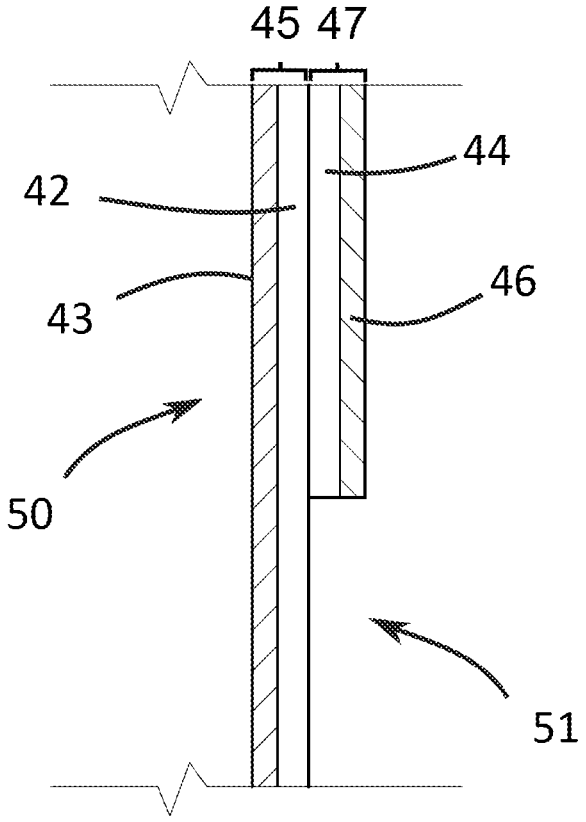
FIG. 12 is a cross section of the wall structure of the helmets of FIGS. 7 to 10 in an uninflated state.

An ideal material for the walls of the longitudinal members is a laminate material formed from a lamina of airtight thermoplastic polyurethane (TPU), and a lamina of woven plastic material such as Nylon 66. A single layer of this laminate material, provided both lamina are intact is itself airtight by virtue of the TPU. Referring to FIG. 12, a double layer material 50 can be conveniently formed by welding two such laminate material layers together, that is, a first sheet of laminar material 45, comprising a first lamina of TPU 42 and a first lamina of woven material 43, to a second sheet of laminar material 47, comprising a second lamina of TPU 44 and a second lamina of woven material 46, the first lamina of TPU 42 and the second lamina of TPU 44 arranged confronting each other. The first and second sheets 45, 47 need not be co-extensive, and in this example a region 51 is shown where the first sheet 45 extends beyond the edge of the second sheet 47. Such a region may run along the length of the material, for example along the first wall 22 where the seam 38 is to be formed with second wall 24.

Figure 13:
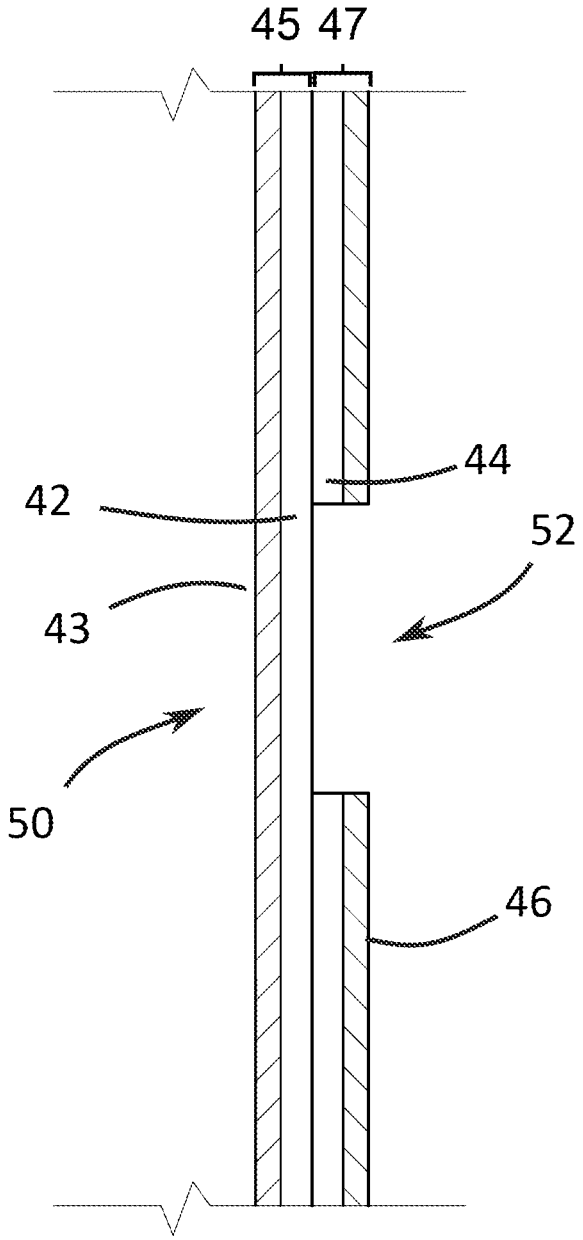
FIG. 13 is a cross section of the wall structure showing a configuration suitable for joining to another wall structure.

Two such sheets of double layer wall material 50 can be joined together by welding the exposed regions 51 of two sheets of material being brought together. Another way of joining two sheets of material is to remove some lamina, to form an exposed area 51. FIG. 13, shows a sheet of double layer wall material 50 where a cutaway hole 52 is formed through the second lamina of TPU 44 and second lamina of woven material 46 of the second sheet of laminar material 47 to expose the first lamina of TPU 42 of the adjoining face of the first sheet of laminar material 45.

Figure 14:
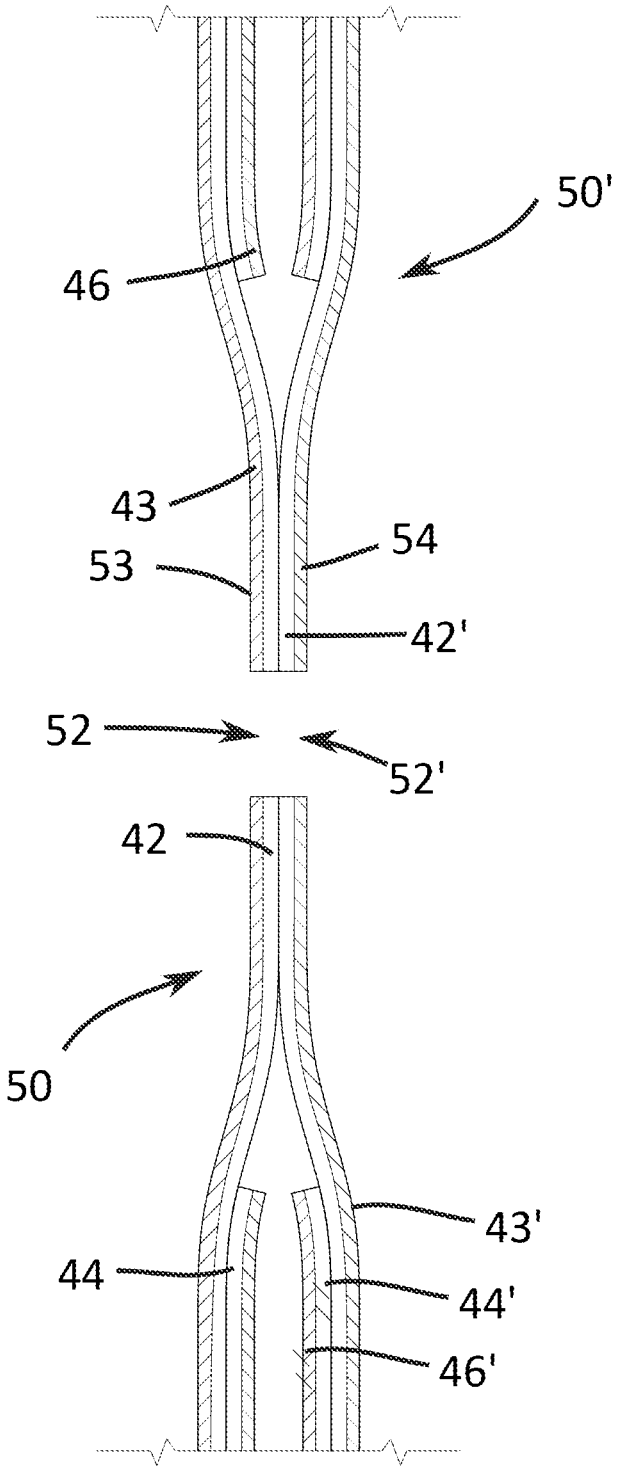
FIG. 14 is a cross section of two wall structures showing them in a joined state.

Referring to FIG. 14, two similar sheets of double layer wall material 50, 50' may be brought together, with similar cutaway holes 52, 52' confronting each other, and the exposed portions of TPU 53, 54 pressed together and welded to form a join between the sheets of double layer wall material 50, 50'. As a result, a fluid communication can be established between two longitudinal members.

Figure 15:
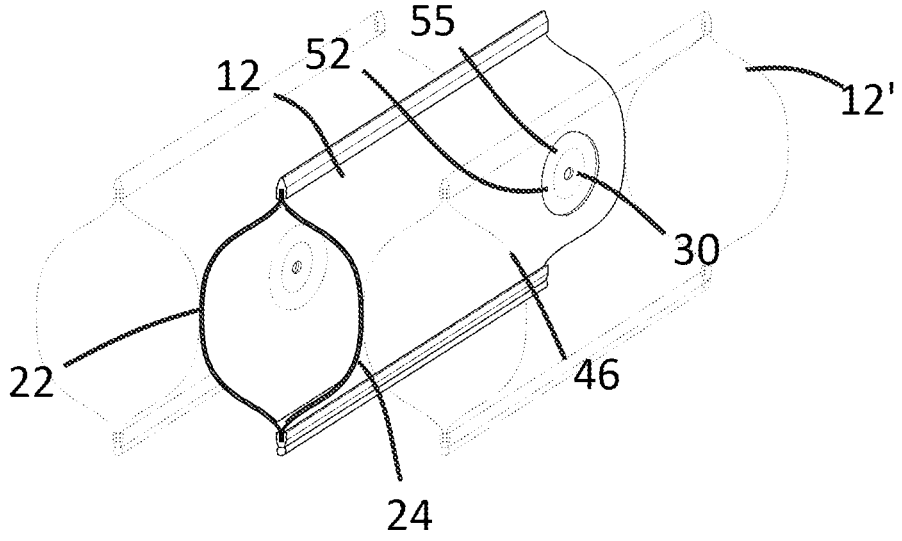
FIG. 15 is a perspective view of longitudinal members having wall structures joined by the system shown in FIG. 14.

Referring to FIG. 15, a longitudinal member 12 has a first wall 22 and second wall 24 formed from the double layer wall material 50 shown in FIG. 11. Where the longitudinal member 12 is to be joined by a node to a neighboring longitudinal member 12', the outermost laminae of TPU and woven material are removed to form a cutaway hole 52 to leave region having the structure shown in FIG. 12, with an exposed region 55 of TPU exposed. An aperture 30 is formed through the TPU and woven material in this exposed region 55.

In order to join the longitudinal members 12 with a neighboring longitudinal member 12', the other longitudinal member is similarly prepared with a cutaway hole located to confront cutaway hole 52, with the apertures aligned. The TPU in the two exposed regions 55 are pressed together and welded. The opposing surfaces of exposed TPU welding in this manner form a secure hermetically sealed joint, and the aligned apertures 30 through the walls of the longitudinal members allow fluid communication between the longitudinal members in the manner previously described.

The welding process for joining laminae of TPU arranged in confrontation may be high frequency (HF) welding. This process uses radio frequency energy to join the abutting TPU laminae of material due to the ultrasonic vibration of molecules within the TPU material, and gives a strength at the join which is equivalent to the base structural strength of the material itself. The resulting joint between two laminae of TPU is also airtight. The node weld using this system is leak proof, is as strong as the actual base material and tested at BSI laboratory to pass an EN1078 structural drop test and repeat testing. Other forms of welding or joining may be suitable, such as heat welding or solvent welding may be used, provided the resulting welds or joins have sufficient strength and airtight sealing qualities.

The laminae of woven material may have a weave direction, and this will typically give structural properties that vary dependent on direction. Referring to back to FIG. 11, the first lamina of woven material 43 and the second lamina of woven material 46 may be arranged so that that the weave direction of the first lamina of woven material 43 is ideally rotated 45 degrees from the weave direction of the second lamina of woven material 46. The woven material may have both a weave and a weft, typically perpendicular to one another, so orienting one woven lamina at 45 degrees to the other ensures both the weave and weft of that lamina are differently oriented to both the weave and weft of the other woven lamina, providing good strength qualities in any direction. Other differing orientation angles of the two woven laminae may though be implemented.

The double wall material provides strength for the chamber of each longitudinal member when inflated or in the stress of impact; it is also resistant to stretching. Referring to back to FIG. 10, the upper perimeter of the inner material 26 is offset with respect to the outer material to leave an upper perimeter of only the outer material 25 around the edges. This then allows for the outer material 25 of the first wall 22 to be welded or laminated to the outer material 25 of the second wall 24 (the second wall being similar to the first wall, but having the lamina order reversed or reflected) to form the surface to surface connection 38 and thus the chamber as previously described, the same process is also used at the lower region of the longitudinal members 12, 14 to form the lower surface to surface connection.

The resulting weld seams run longitudinally along the length of the helmet structure, forming a major structural element and becomes a rib member 35, 36 that helps constrain the forces under inflation, ultimately spreads loading forces under or during impact along the length of that particular chamber; that is, the rib stops the curved shape or profile of the longitudinal member from opening out or uncurling.

The double laminae structure also allows for a slit to be created between the laminae so that the interior nodes can be accessed from inside the chamber to be welded to the next chamber from interior to interior if desired. Once the nodes are welded, the slit is then welded up. The slit is offset so the outer lamina slit intentionally misaligns with the inner lamina to be sure there is always at least one lamina of woven material on the surface.

A weld connection point may be formed by removing a lamina of woven material and TPU material from aligned portions of double walled material and welding the confronting TPU surfaces as for forming a node, but without forming a through hole so that the connection is blank or blind, so that the adjacent longitudinal members are bonded together but are not in fluid communication at this point.

Both nodes having through hole connections, and blind weld connection points may be placed at any point along the chamber with a minimum of design alteration; the removal of one lamina of woven material and one lamina of TPU material from the double wall to form a node may be carried out.

Forming a weld or joining by removing material from the double wall material in this manner gives a flat weld connection which is equal to the thickness of the original material. Ultimately this allows the overall design to be compressed flat when not in use so that it is no thicker than the total number of layers of flat material. The weld points are in fact slightly thinner. Due to the nature of this process the forces exerted on the weld are equalized as they are distributed through the wall of the chamber, so do not build up at one point.

At nodes where a through-hole aperture is formed, the size of the aperture determines the resistance to airflow during an impact, allow the strength of the chamber and structure to be predetermined. The diameter of the aperture may be at least about 1 mm. Preferably, the diameter of the aperture is at least about 3 mm. The diameter of the aperture may be less than or equal to about 7 mm. Preferably, the diameter of the aperture is less than or equal to about 6 mm. The diameter of the aperture may be between about 1 mm and about 7 mm. Preferably, the diameter of the aperture is between about 3 mm and about 6 mm. Preferably, the diameter of the aperture is about 5 mm.

Preferably, the helmet is formed as a completely sealed unit that can be inflated and deflated, preferably repeatedly. Therefore, the helmet preferably includes at least one air inlet port (not shown) that can be used to inflate or deflate the helmet. The air inlet port or valve may provide a fluid communication with at least one of the elongate members of the helmet. The air inlet port may be configured to allow air to enter and exit the helmet. Alternatively, a separate or additional air outlet port may be provided on the helmet to allow air to exit the helmet.

An air inlet (or outlet) port is provided on one of the internal elongate members. The air inlet (or outlet) port may be provided on one of the elongate members that is located on, or in the vicinity of, a central portion of the helmet. This may ensure that the helmet is evenly and efficiently inflated during the inflation as well as evenly deflated during deflation.

The at least one air inlet or outlet port may comprise a valve. Preferably, such a valve may be a Schrader valve or a Presta valve. This is particularly beneficial as it means the helmet can be inflated with a conventional bicycle pump. The rigidity of the helmet material and design, particularly in an inflated state, allows for a relatively low internal air pressure within the helmet in order for the helmet to perform safely upon impact. In one embodiment, the internal pressure within the helmet in an inflated state is between about 18 Psi and about 22 Psi. This may enable a user to repeatedly inflate or deflate the helmet relatively quickly and with ease.

A piece of material comprising a TPU lamina and lamina of woven material may be affixed as a patch on a first wall (having at least an outer TPU lamina) of one of the elongate members to provide a double wall in that area, and this patch may be formed with a cutaway hole to leave exposed the first lamina of TPU of the first wall so that the first wall's TPU may be brought together and welded to the TPU lamina of a neighboring elongate member.

The principles described herein of joining inflatable members together by bonding abutting walls to form nodes (either structural joining nodes, or fluid communication nodes) may equally be applied to other inflatable articles (i.e. articles other than inflatable helmets). Similarly, the principles described herein of bonding a seam of an inflatable member may equally be applied to other inflatable articles.

The techniques described in the present disclosure are particularly suitable to inflatable articles that are required to be capable of being compressed to a flatter shape, and where relatively high rigidity in the inflated form is desirable, particularly for articles that have a safety or buffering purpose, or are subjected to large impact forces.

In particular, for inflatable articles of the present disclosure, a number of inflatable chamber members may be joined together by nodes as described in relation to helmet above, the members wholly or partially composed of a material having a first wall and a second wall which are superimposed or overlap each other, and wherein the one of these walls is absent from a region surrounding the coincident apertures. These members can then be joined by nodes in the same manner as previously described, and conveniently they can employ the same structure of first and second lamina in a wall, one layer being weldable. Further the nodes joining the members may, as for the helmet described above, be distributed at different positions for different pairs of joined members, so that the nodes along one side of a member are longitudinally offset from the nodes on the other side of that member, so that air flow through the inflated article (in the event of an impact) must take a convoluted path, increasing the rigidity and resistance to the impact.

The wall structure described herein comprises a lamina of woven Nylon 66 and a lamina of TPU capable of being welded to form an airtight seal. It will however be realized that other suitable plastic materials could be used; for example, instead of Nylon 66, polyester or aramid composite could be used.

Further examples of the present disclosure can be described with reference to following numbered clauses:

1. An inflatable article comprising a plurality of inflatable members, each inflatable member comprising at least one chamber wall defining an inflatable chamber;

wherein at least two adjacent inflatable members are in fluid communication with each other; and wherein the plurality of inflatable members is inflatable so as to adjust the inflatable article from a collapsed state to an inflated state in which at least one pair of adjacent inflatable members abut one other along at least a portion of their respective chamber walls.

2. An inflatable article according to clause 1, wherein the plurality of inflatable members is deflatable so as to adjust the inflatable article from an inflated state to a collapsed state.

3. An inflatable article according to clause 1 or 2, wherein each of the inflatable members is substantially flattened in a collapsed state such that the shape of the article in a collapsed state is substantially flatter than the shape of the article in an inflated state.

4. An inflatable article according to any preceding clause, wherein the inflatable members extend substantially in a longitudinal direction of the article.

5. An inflatable article according to any preceding clause, wherein the inflatable members are substantially parallel to one another in a collapsed state.

6. An inflatable article according to any preceding clause, wherein each inflatable member comprises at least one aperture defined in the chamber wall and wherein the at least one aperture of an inflatable member is fluidly connected to at least one corresponding aperture of an adjacent inflatable member.

7. An inflatable article according to clause 6, wherein the at least one aperture of an inflatable member is coupled to at least one corresponding aperture of an adjacent inflatable member.

8. An inflatable article according to any preceding clause, wherein the plurality of inflatable members comprises two external inflatable members and at least one internal inflatable member located between the external inflatable members;

wherein the at least one internal inflatable member comprises at least one first aperture located on a first side of the inflatable chamber and at least one second aperture located on an opposing second side of the inflatable chamber; and wherein the at least one first aperture of an internal inflatable member is fluidly connected to at least one corresponding aperture of an adjacent inflatable member and the at least one second aperture of an internal inflatable member is fluidly connected to at least one corresponding aperture of another adjacent inflatable member.

9. An inflatable article according to any one of clauses 6 to 8, wherein each inflatable member comprises a plurality of apertures defined in the chamber wall and wherein the plurality of apertures are longitudinally spaced.

10. An inflatable article according to any one of clauses 6 to 9, wherein the portion of the chamber wall surrounding the at least one aperture of an inflatable member is coupled to the portion of the chamber wall surrounding the at least one corresponding aperture of an adjacent inflatable member such that an airtight seal is provided around the apertures.

11. An inflatable article according to any preceding clause, wherein the chamber wall of each inflatable member comprises an inner layer and an outer layer.

12. An inflatable article according to clause 11, wherein a portion of the chamber wall surrounding the at least one aperture consists of the inner layer.

13. An inflatable article according to clause 11 or 12, wherein the chamber wall of each inflatable member comprises at least one longitudinal seam, the at least one longitudinal seam being formed by joining a longitudinal portion of one of the inner layer and outer layer to another longitudinal portion of either the same one of the inner layer and outer layer or a different one of the inner layer and outer layer.

14. An inflatable article according to any one of clauses 11 to 13, wherein the inner layer comprises an outer lamina of plastic material and an inner lamina of woven material and the outer layer comprises an outer lamina of woven material and an inner lamina of plastic material, wherein at least a portion of the inner lamina of the outer layer overlapping the outer lamina of the inner layer is joined to the outer lamina of the inner layer such that an airtight seal is formed between the outer and inner layers of the chamber wall.

15. An inflatable article comprising a plurality of inflatable members, each inflatable member comprising at least one chamber wall defining an inflatable chamber, wherein each inflatable member comprises at least one aperture defined in the chamber wall and wherein the at least one aperture of an inflatable member is fluidly connected to at least one corresponding aperture of an adjacent inflatable member;

wherein the portion of the chamber wall surrounding the at least one aperture of an inflatable member is coupled to the portion of the chamber wall surrounding the at least one corresponding aperture of an adjacent inflatable member such that an airtight seal is provided around the apertures;

wherein the chamber wall of each inflatable member comprises an inner layer and an outer layer and wherein a portion of the chamber wall surrounding the at least one aperture consists of one of the inner layer and the outer layer, preferably the inner layer;

the inflatable article being inflatable from a collapsed state to an inflated state, in which each of the inflatable members are inflated and adjacent inflatable members abut each other along at least a longitudinal portion of their respective chamber walls.

16. An inflatable article according to clause 15, wherein the inflatable article is collapsible from an inflated state to an collapsed state.

17. An inflatable article according to clause 15 or 16, wherein, in a collapsed state, each of the inflatable members are substantially flattened such that the shape of the article in a collapsed state is substantially flatter than the shape of the article in an inflated state.

18. An inflatable article according to any one of clauses 15 to 17, wherein the inflatable members extend along a longitudinal direction of the article.

19. An inflatable article according to any one of clauses 15 to 18, wherein the inflatable members are arranged substantially parallel to each other.

20. An inflatable article according to any one of clauses 15 to 19, wherein the chamber wall of each inflatable member comprises at least one longitudinal seam, the at least one longitudinal seam being formed by joining a longitudinal portion of one of the inner layer and outer layer to another longitudinal portion of either the same one of the inner layer and outer layer or a different one of the inner layer and outer layer, preferably the at least one longitudinal seam being formed by joining a longitudinal portion of an outer layer to another longitudinal portion of either the same outer layer or a different outer layer.

21. An inflatable article according to any one of clauses 15 to 20, wherein the inner layer comprises an outer lamina of plastic material and an inner lamina of woven material and the outer layer comprises an outer lamina of woven material and an inner lamina of plastic material, wherein at least a portion of the inner lamina of the outer layer overlapping the outer lamina of the inner layer is joined to the outer lamina of the inner layer such that an airtight seal is formed between the outer and inner layers of the chamber wall.

22. An inflatable article according to any preceding clause, wherein the inflatable member is elongated.

While the disclosure has been illustrated and described in detail in the drawings and the foregoing description, such illustration and description are to be considered illustrative or exemplary and not restrictive. The disclosure is not limited to the disclosed embodiments. From reading the present disclosure, other modifications will be apparent to a person skilled in the art. Such modifications may involve other features, which are already known in the art and may be used instead of or in addition to features already described herein. In the claims, the word "comprising" does not exclude other elements or steps, and the indefinite article "a" or "an" does not exclude a plurality.

Although this disclosure refers to specific embodiments, it will be understood by those skilled in the art that various changes in form and detail may be made without departing from the subject matter set forth in the accompanying claims.

The invention claimed is:

1. An inflatable helmet comprising:

a plurality of elongate inflatable members, each elongate inflatable member extending along a longitudinal direction that extends from a rear end of the helmet to a front end of the helmet, and wherein the plurality of elongate inflatable members extend across the entire width of the helmet;

wherein each elongate inflatable member comprises at least one chamber wall defining an inflatable chamber;

wherein at least two adjacent elongate inflatable members of the plurality of elongate inflatable members are in fluid communication with each other;

wherein the plurality of elongate inflatable members are inflatable so as to adjust the inflatable helmet from a collapsed state to an inflated state in which at least one pair of adjacent elongate inflatable members abut one another along at least a portion of the respective at least one chamber wall of each of the at least one pair of adjacent elongate inflatable members;

wherein, in the inflated state, the plurality of elongate inflatable members define a curved profile of the helmet transverse to the longitudinal direction so as to extend across the width of a user's head when placed on the head and wherein the plurality of elongate inflatable members are configured to contract transversely so that the elongate inflatable members are substantially parallel to one another in the collapsed state;

wherein each elongate inflatable member comprises at least one aperture defined in the at least one chamber wall and wherein the at least one aperture of a first elongate inflatable member of the plurality of elongate inflatable members is fluidly connected to the corresponding at least one aperture of an adjacent second elongate inflatable member of the plurality of elongate inflatable members;

wherein the plurality of elongate inflatable members comprises two external elongate inflatable members and at least one internal elongate inflatable member located between the external elongate inflatable members, the at least one internal elongate inflatable member being shorter than the adjacent elongate inflatable members to occupy the space between the adjacent elongate inflatable members;

wherein the at least one internal elongate inflatable member comprises at least one first aperture located on a first side of the respective inflatable chamber and at least one second aperture located on an opposing second side of the respective inflatable chamber; and wherein the at least one first aperture of the at least one internal elongate inflatable member is fluidly connected to at least one corresponding aperture of an adjacent elongate inflatable member of the plurality of elongate inflatable members and the at least one second aperture of the at least one internal elongate inflatable member is fluidly connected to at least one corresponding aperture of another adjacent elongate inflatable member of the plurality of elongate inflatable members.

2. An inflatable helmet according to claim 1, wherein the plurality of elongate inflatable members is deflatable so as to adjust the inflatable helmet from the inflated state to the collapsed state.

3. An inflatable helmet according to claim 1, wherein each of the elongate inflatable members is substantially flattened in the collapsed state such that the shape of the helmet in the collapsed state is substantially flatter than the shape of the helmet in the inflated state.

4. An inflatable helmet according to claim 1, wherein the elongate inflatable members extend substantially in the longitudinal direction of the helmet, the elongate inflatable members being tapered at their respective terminal ends such that the plurality of elongate inflatable members fit together in a hemispherical arrangement in the inflated state.

5. An inflatable helmet according to claim 1, wherein the at least one aperture of the first elongate inflatable member is coupled to the corresponding at least one aperture of the adjacent second elongate inflatable member.

6. An inflatable helmet according to claim 1, wherein each elongate inflatable member comprises a plurality of apertures defined in the at least one chamber wall and wherein the plurality of apertures are longitudinally spaced.

7. An inflatable helmet according to claim 1, wherein the portion of the at least one chamber wall surrounding the at least one aperture of an elongate inflatable member is coupled to the portion of the at least one chamber wall surrounding the at least one corresponding aperture of an adjacent elongate inflatable member such that an airtight seal is provided around the apertures.

8. An inflatable helmet according to claim 1, wherein the at least one chamber wall of each elongate inflatable member comprises an inner layer and an outer layer.

9. An inflatable helmet according to claim 8, wherein a portion of the at least one chamber wall surrounding the at least one aperture consists of the inner layer.

10. An inflatable helmet according to claim 9, wherein the at least one chamber wall of each elongate inflatable member comprises at least one longitudinal seam, the at least one longitudinal seam being formed by joining a longitudinal portion of one of the inner layer and outer layer to another longitudinal portion of either the same one of the inner layer and outer layer or a different one of the inner layer and outer layer.

11. An inflatable helmet according to claim 9, wherein the inner layer comprises an outer lamina of plastic material and an inner lamina of woven material and the outer layer comprises an outer lamina of woven material and an inner lamina of plastic material, wherein at least a portion of the inner lamina of the outer layer overlapping the outer lamina of the inner layer is joined to the outer lamina of the inner layer such that an airtight seal is formed between the outer and inner layers of the at least one chamber wall.

12. An inflatable helmet according to claim 8, wherein the at least one chamber wall of each elongate inflatable member comprises at least one longitudinal seam, the at least one longitudinal seam being formed by joining a longitudinal portion of one of the inner layer and outer layer to another longitudinal portion of either the same one of the inner layer and outer layer or a different one of the inner layer and outer layer.

13. An inflatable helmet according to claim 12, wherein the inner layer comprises an outer lamina of plastic material and an inner lamina of woven material and the outer layer comprises an outer lamina of woven material and an inner lamina of plastic material, wherein at least a portion of the inner lamina of the outer layer overlapping the outer lamina of the inner layer is joined to the outer lamina of the inner layer such that an airtight seal is formed between the outer and inner layers of the at least one chamber wall.

14. An inflatable helmet according to claim 8, wherein the inner layer comprises an outer lamina of plastic material and an inner lamina of woven material and the outer layer comprises an outer lamina of woven material and an inner lamina of plastic material, wherein at least a portion of the inner lamina of the outer layer overlapping the outer lamina of the inner layer is joined to the outer lamina of the inner layer such that an airtight seal is formed between the outer and inner layers of the at least one chamber wall.

* * * * *